United States Patent [19]

Biddle et al.

[11] 4,009,302

[45] Feb. 22, 1977

[54] METHOD OF COATING A GAS RANGE TOP BURNER

[75] Inventors: William P. Biddle; John J. Tacker, both of Athens, Tenn.

[73] Assignee: Athens Stove Works, Inc., Athens, Tenn.

[22] Filed: June 6, 1975

[21] Appl. No.: 584,655

Related U.S. Application Data

[62] Division of Ser. No. 498,303, Aug. 19, 1974, Pat. No. 3,922,138.

[52] U.S. Cl. ..... 427/238; 427/239; 427/330; 427/376 R; 427/435; 431/193

[51] Int. Cl.[2] ..... F24C 3/10; C23D 5/02

[58] Field of Search ..... 427/376, 330, 238, 239, 427/435; 431/192, 193; 239/577, 567, 548

[56] References Cited

UNITED STATES PATENTS

| | | | |
|---|---|---|---|
| 2,490,885 | 12/1949 | Reeves | 431/193 |
| 2,539,101 | 1/1951 | Reeves | 239/567 X |
| 2,595,005 | 4/1952 | Shelton et al. | 239/548 X |
| 3,219,098 | 11/1965 | Fulmer | 431/193 X |
| 3,619,099 | 11/1971 | Moss et al. | 431/192 |
| 3,858,811 | 1/1975 | Mizerak | 239/567 X |
| 3,922,138 | 11/1975 | Biddle et al. | 431/193 |

FOREIGN PATENTS OR APPLICATIONS

| | | | |
|---|---|---|---|
| 1,078,903 | 8/1967 | United Kingdom | 427/238 |

*Primary Examiner*—Ralph S. Kendall

*Attorney, Agent, or Firm*—McNenny, Pearne, Gordon, Gail, Dickinson & Schiller

[57] ABSTRACT

A burner assembly in which various elements are joined in a manner which ensures gastight integrity of the assembly. A porcelain-coated base plate is formed of a pair of overlying steel sheets with integral embossments defining air-gas ducts to burner heads mounted on the base plate and defining ignition tubes for conducting a flame from a pilot housing to the burner heads. The air-gas ducts are sealed by establishing a pressurized flow of a slurry of ceramic frit therethrough, which is effective to coat the full interior of the ducts and close any crevices formed between the sheets. The burner head elements are arranged to provide metal-to-metal sealing engagement with peripheral edges of apertures in the base plate sheets which are characteristically free of porcelain enamel coating. An annular embossment on one of the sheets is preloaded by deflecting it toward the other sheet during assembly of the burner head elements. The embossment is locked into the stressed preloaded condition by permanent deformation of a flange on one of the burner head elements in a manner which transfers the preload force to the contact areas of the various head elements and base plate to ensure that their engagement is gastight. The structure of the burner heads and base plate is arranged to increase the contacting forces between the various elements during operation as a result of differential thermal expansion of the elements.

5 Claims, 6 Drawing Figures

Fig. 4
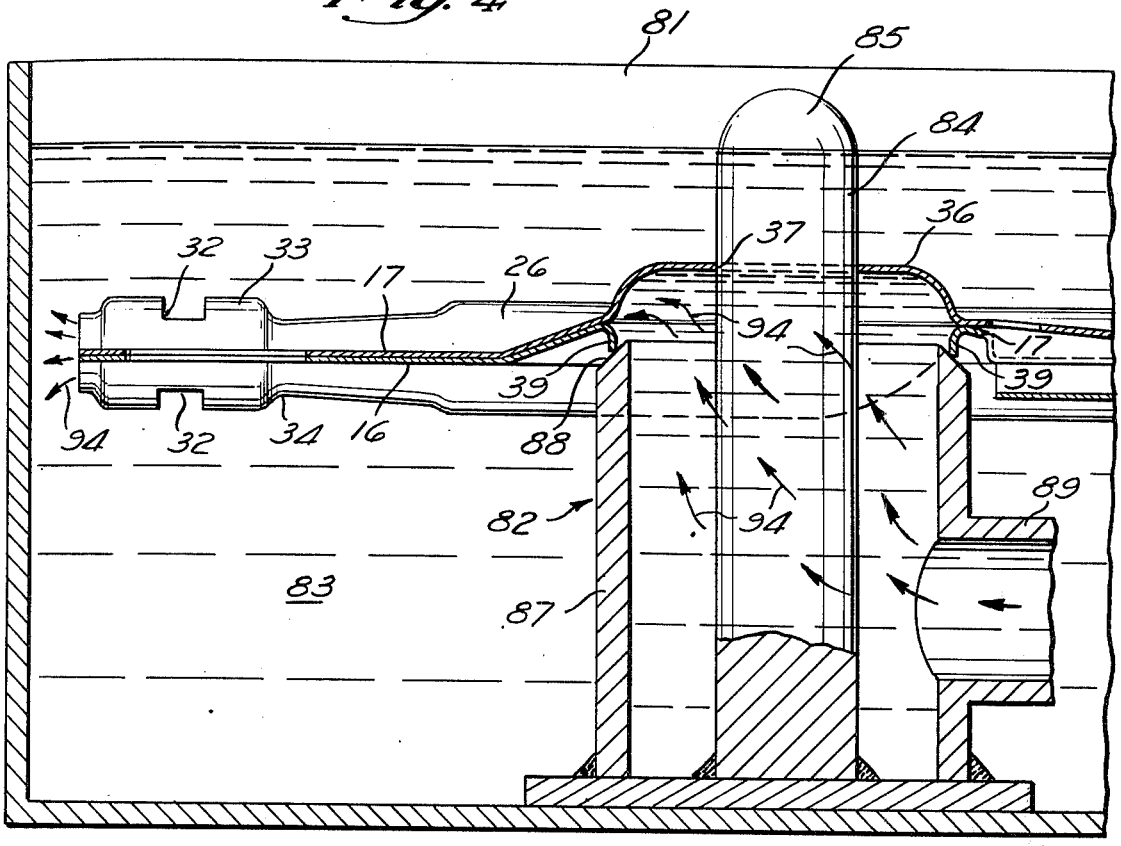
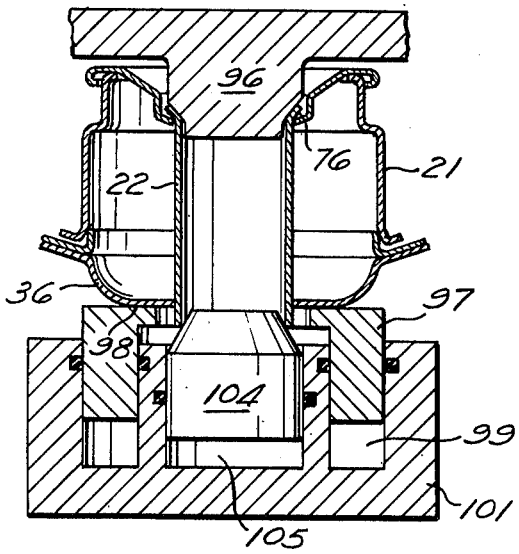
Fig. 5
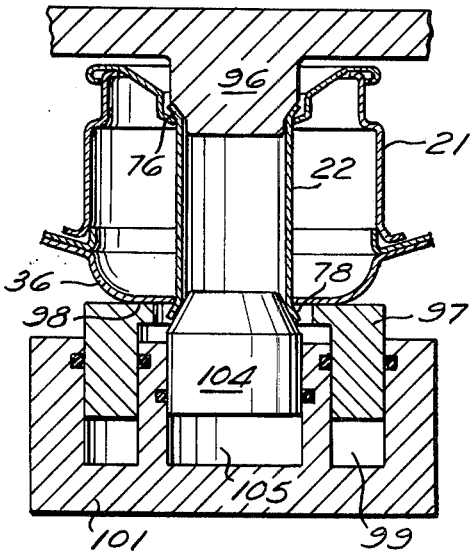
Fig. 6

METHOD OF COATING A GAS RANGE TOP BURNER

This is a division of application Ser. No. 498,303 filed Aug. 19, 1974 now U.S. Pat. No. 3,922,138.

BACKGROUND OF THE INVENTION

The invention relates to top burner assemblies for gas ranges and, more specifically, relates to an improved structure and method for such assemblies.

PRIOR ART

Burner assemblies of the type to which the present invention is directed generally include one or more burner heads mounted on a plate of formed sheet metal, which includes integrally stamped air-fuel mixture supply channels. Various parts of the assembly are usually porcelain enameled for reasons of apperance, ease of cleaning, and resistance to corrosion. It is known in the prior art to enamel the various parts of the assembly either before or after they are joined. Where parts are assembled after they have been emameled, it is customary to provide gaskets between the surfaces of separate parts to seal the inherently irregular surface of porcelain enamel. Nonmetallic gaskets used in the prior art for sealing various parts have been subject to failure either through improper initial assembly or by deterioration in use, and have added their cost to that of the assembly.

U.S. Pat. No. 3,619,099 to Moss et al. discloses a burner assembly of the aforementioned type, of sandwiched metal sheets, and teaches sealing of the periphery of the sheets by an enamel coating after the sheets have been spot-welded together. The prior art also includes U.S. Pat. Nos. 2,470,881 to Zimbelman and 2,497,787 to Minster, directed to burner assemblies; and U.S. Pat. No. 866,821 to Speer, directed to a method of enameling the interior of sheet metal vessels. An example of a burner assembly in which gaskets are used in the burner assembly is U.S. Pat. No. 2,595,005 to Shelton et al.

SUMMARY OF THE INVENTION

The invention provides a gas range top burner in which the component parts are formed and assembled by a method which ensures the gastight integrity of the joints between the various parts. The coating properties of porcelain enamel are put to full advantage in the practice of the invention, wherein the enamel itself is used to form gastight seal between certain elements and wherein in other selected areas, the characteristic nonwetting of the enamel on a sharp edge enables enamel-free edges to be employed in metal-to-metal sealing contact.

In the disclosed embodiment, the burner assembly includes a base plate comprising a pair of substantially coextensive metal sheets spot-welded together. The sheets are embossed with air-fuel mixture ducts and associated burner head receiving holes. In accordance with the invention, the ducts are reliably sealed by producing a pressurized flow of a slurry of ceramic frit through the ducts to thereby eliminate air pockets and resulting imperfections, and to force frit particles into any crevices or cracks between the sheets. Ideally, coating of the exterior of the base plate ducts is accomplished simultaneously with the coating of the interior of the plate by submerging the entire plate in a slurry and simultaneously pumping a volume of the slurry through the air-fuel mixture ducts.

The burner head is fabricated from a number of annular parts which engage and close off complementary apertures in the base plate. The characteristic nonwetting or pull-back of the porcelain enamel from an edge is turned to advantage at the joints between the base plate and burner head elements. The enameled portions of the elements, as well as complementary apertures of the base plate, are arranged for edge contact with adjoining surface portions. A positive metal-to-metal seal between components is thus achieved.

Structural features of the burner head and method of its assembly augment the performance of the edge seals by ensuring a stressed fit between the burner head components and base plate. During final assembly, the parts are positioned together with an inner shell forming a secondary air supply or chimney extending through an aperture in the base plate. The aperture is provided in a disc-like resiliently deformable embossment in one of the sheets forming the base plate. The embossed disc is preloaded by deflecting it with a predetermined force, and the inner shell is subsequently permanently deformed by flaring it outwardly into engagement with the associated aperture. The preload on the disc tends to maintain the joint between its aperture and the inner shell, and remaining edge joints of the burner head as well, in gastight sealing engagement at room temperature. Further, the various parts of the burner head are arranged to increase the sealing forces on the joints between the parts when the temperature of the head is elevated during burning operations. This increased sealing effectiveness results from the geometry of the various elements, and a differential expansion of certain elements due to differential temperatures existing in the head during warm-up and steady state operation.

BRIEF DESCRIPTION OF THE DRAWINGS

FIG. 4 is an elevational, sectional view of an enamel dip tank and submerged fountain for pressure coating the interior of the base plate;

FIG. 5 is an elevational, cross sectional view of apparatus for assembling the burner head to the base plate in a first-stage of operation; and FIG. 6 is a view similar to FIG. 5, illustrating the burner head assembly apparatus in a second stage of operation.

DESCRIPTION OF THE PREFERRED EMBODIMENT

Figure 1:
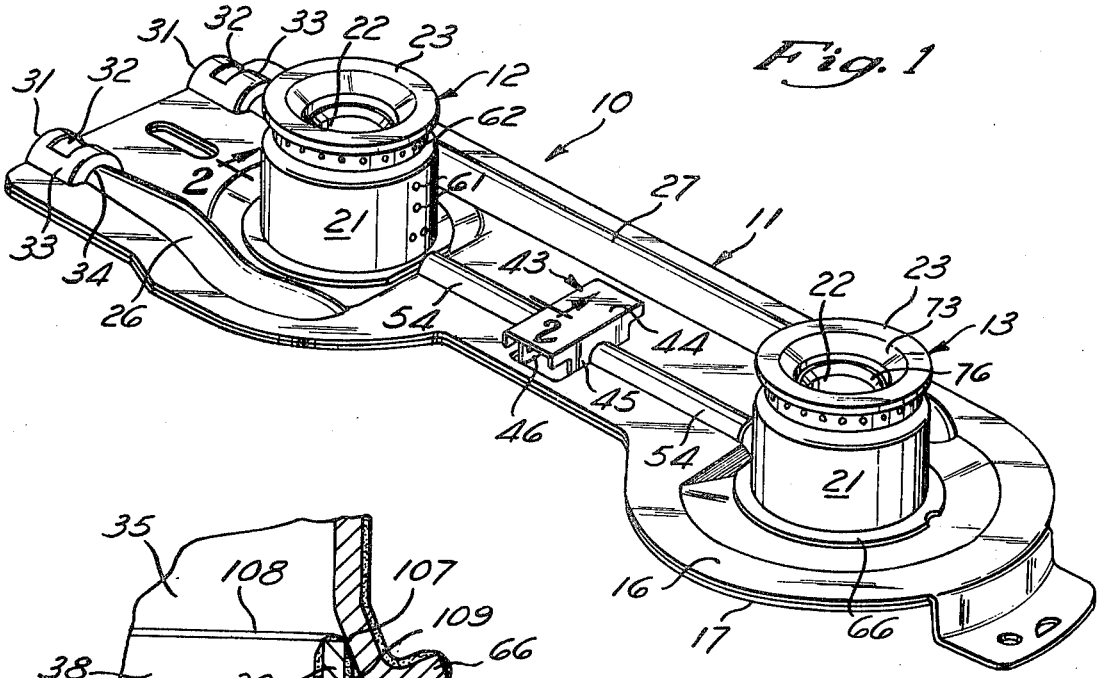
FIG. 1 is a perspective view of a burner assembly embodying the principles of the invention.

Referring now to the drawings, and in particular FIG. 1, a burner assembly 10 includes a base plate 11 and a pair of spaced burner heads 12 and 13. The base plate 11 is principallly formed of a pair of embossed metal sheets in overlying relation and generally coextensive with one another. Each burner head 12 and 13 includes an outer shell 21, an inner sheel 22, and an annular cap 23.

In the illustrated embodiment, the base plate 11 has provision for mounting the pair of substantially identical burner heads 12 and 13, but it is contemplated that the principles of the invention may be applied to a single one or a greater number of burner heads. The metal base plate sheets 16 and 17 are stamped or otherwise formed with substantially identical profiles in their planes and with embossments forming complementary longitudinal halves of air-gas ducts 26 and 27. Each duct 26, 27 extends in a direction lengthwise of the base plate 11 to conduct an air-gas mixture from an inlet 31 to an associated burner head 12 and 13, respectively. The sheets 16 and 17 are secured together by a plurality of spot welds, spaced through their contacting areas and adjacent the ducts 26, 27. Gas is admitted into the ends 31, under control of a suitable valve, and is mixed with air entering inlet openings 32 as it passes a mixing area 33 and a venturi restriction 34.

A delivery end of each duct 26 and 27 tangentially communicates with a plenum chamber 35 at its associated burner head 12 and 13. A plenum chamber 35 is formed by the outer and inner shells 21 and 22, the annular cap 23, and an annular cup-shaped embossment 36 in the lower sheet 17. An aperture 37 in the embossment 36 of the lower plate 17 receives the inner shell 22. An aligned and somewhat larger aperture 38 in the upper plate 16 is bounded by a cylindrical upturned flange 39 which supports the outer shell 21.

A pilot flame housing 43 is provided on the base plate midway between the burner heads 12 and 13. The pilot flame housing 43 includes an inverted U-shaped, rectangular bracket 44 of sheet metal. Each leg 45 of the bracket is suitably secured to the upper sheet 16, as by a pair of integral, oppositely facing tabs 46, which engage the inner side or surface 47 of the upper sheet. A conical embossment 51 in the lower sheet 17 provides clearance for the tabs 46, and is adapted to direct a pilot flame through a central aperture 52. A pair of ignition tubes 54 and 55 extend from opposite side of the pilot flame housing 43 to the burner heads 12 and 13. Respective longitudinal halves of the ignition tubes 54 and 55 are integrally formed or embossed in the top and bottom base plate sheets 16 and 17.

In the known manner, an air-gas mixtue escaping from the plenum chamber 35 of a burner head 12 or 13 through a pilot charge aperture 58 in the outer shell 21 enters an adjacent open end 59 of an ignition tube 54. The escaping gas travels the length of the ignition tube to the pilot flame in the housing 44, is ignited, and allows the flame to flash back through the tube and, by cascade ignition of gas from a set of vertically aligned apertures 61 in the outer burner shell 21, to ignite gas from a plurality of main burner apertures 62 in the outer shell 21.

An advantage of the integral ignition tube construction in the base plate 11 is improved reliability in burner ignition. Consistent and dependable burner ignition is dependent on precise positioning of the ignition tube 54, burner heads 12, 13 and pilot charge aperture 58, the inlet end of the ignition tube, the configuration of the ignition tube, and the relationship of the termination of the ingition tube and the pilot frame opening 58. Dimensional and operational variations, when an ignition tube and its support are separately formed and subsequently attached to a base plate, give rise to inconsistent results and often require manual adjustment.

Figure 3:
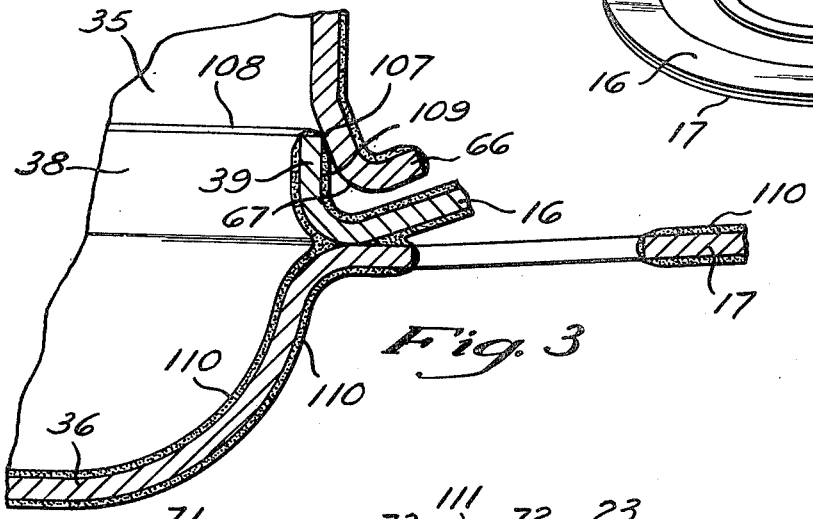
FIG. 3 is an enlarged view of an edge sealing area, circled in FIG. 2, between portions of the burner head and base plate.
Figure 2:
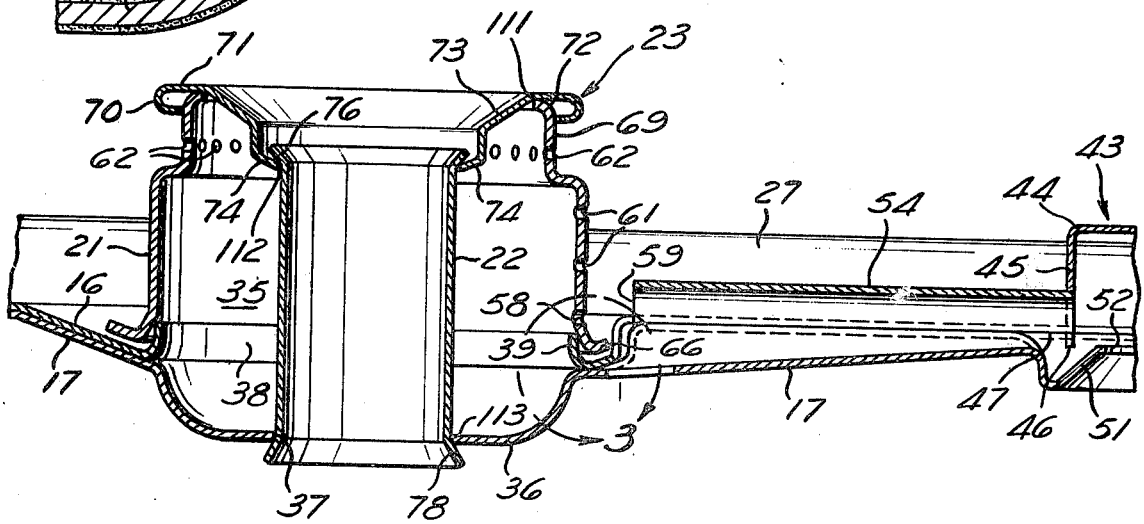
FIG. 2 is a fragmentary, cross sectional view, in elevation, taken along the line 2—2 indicated in FIG. 1, illustrating details of a burner head and its mounting on the base plate.

An outwardly turned flange 66 on a lower end of the outer burner shell 21 provides stiffening of the shell and a conical surface 67 for oblique contact with and support by the aperture flange 39 on the base plate 11 (see FIG. 3). An upper wall portion 69 of the outer shell 21 associated with the burner apertures 62 is recessed under a peripheral reversed flange 70 of the cap 23. The underside of an upper flat portion 71 of the cap is obliquely engaged and supported by an inturned flange 72 at the upper end of the outer shell 21. A central section 73 of the cap 23 extends conically downwardly from the flat portion 71 to an inturned flange 74, which obliquely contacts and supports the underside of an outwardly flared end or flange 76 of the inner shell 22. The inner shell 22 is formed from a length of steel or other metal tubing and includes a second flare or flange 78 at its lower end. This latter flange 78 is obliquely engaged by the wall of the annular cup-shaped embossment 36 in which the aperture 37 is formed.

An important aspect of the invention involves a method of coating the base plate 11 with ceramic frit for forming a porcelain enamel coating on the plate. The porcelain coating, in addition to providing an attractive appearance, corrosion resistance, and an easily cleaned surface, is employed to seal the interface between the plates 16 and 17 in the area of the ducts 26 and 27 and plenum chamber 35. It has been recognized that a relatively low internal gas pressure in these ducts or passageways of even approximately one-tenth or four-tenths inch of water is sufficient to develop a leak in a very small hole or crack.

To ensure that the joint or interface between these sheets 16, 17 is completely sealed, a pressurized flow of a water slurry of ceramic frit is introduced into the ducts 26, 27 in accordance with the invention. This pressurized flow is developed with sufficient velocity and turbulence to eliminate air pockets and coating defects which would otherwise result from such pockets. The fluid pressure simultaneously causes suspended frit particles to be positively driven into any cracks or crevices between the plates which would otherwise present a potential gas leakage path. Ideally, the pressurized flow is developed in a dip tank so that both the interior and exterior surfaces of the base plate 11 are coated simultaneously.

These coating operations are conveniently accomplished with a dip tank 81 and a partially submerged fixture 82 as illustrated in FIG. 4. The dip tank 81 is substantially filled with a water slurry of ceramic frit 83. The fixture 82 includes a mandrel or post 84 (only one is shown) for each burner head on the base plate 11. An upper end 85 of the post is rounded or otherwise tapered to facilitate positioning of the post 84 in the aperture 37 of the embossment 36 of the lower sheet 17. The submerged fixture 82 includes an annular nozzle or fountain 87 concentric about the post 84. The upper send of the nozzle 87 has a conical or beveled end face 88 adapted to center and seal against the burner head supporting flange 39 of the upper plate 16. The post 84 effectively seals the aperture 57. Pressurized flow of the ceramic frit water slurry is introduced into the nozzle 87 from a branch line 89 which is connected to an equivalent fountain structure associated with the other burner station. Advantageously, the pressurized flow is developed by a conventional pump which is normally used to recirculate the slurry and maintain the ceramic particles in suspension. Such an arrangement requires only a single pump to supply pressurized flow to the interior passages or ducts 26 and 27 and simulataneously maintain the frit in suspension.

The direction of flow of the slurry through the nozzle 87 and burner plate duct 26 is indicated by arrows 94. This flow direction through the duct 26 is reversed to that of the normal gas flow. This allows the venturi restriction 34 at the mixing head to develop a positive or greater pressure in the duct 26 than that of the slurry surrounding the exterior of the duct. This positive pressure causes the frit particles suspended in the fluid 83 to be driven into any cracks or crevices existing between the inner face between the sheets 16 and 17.

After exposure to this pressurized flow, the base plate 11 is removed and fired in a conventional manner to fuse the frit particles together and onto the coated surfaces. It will be appreciated that the ducts 26 and 27 are additionally sealed by frit particles which enter the interface between the sheets 16 and 17 from the outer edges of these sheets.

A preferred method of assembling the burner heads 12 and 13 to the base plate 11 is illustrated in FIGS. 5 and 6. The burner head shells 21 and 22 and annular cap 23 are positioned on the base plate 11, with the lower end of the inner shell, in an initially straight condition, extending through the aperture 37 in the annular disc-like embossment 36 of the lower sheet 17. The flared end 76 of the inner shell 22 is positioned against a fixed post 96 having a configuration complementary to the interior of the shell. An annular piston or ring 97 is hydraulically advanced against an outer face 98 of the embossment 36 by pressurized fluid in an associated annular chamber 99 in a ram base 101.

A predetermined pressure is introduced to the annular chamber 99 to produce a suitable elastic deflection of the disc-like embossment 36. While this predetermined pressure is maintained and the diaphragm-like embossment 36 is deflected, a second piston or ram 104 is advanced by fluid pressure in a chamber 105. The ram 104 engages the lower end of the shell or tube 22 and forms the lower flange 78 thereon. As in the case of the annular piston 97, the advance of the ram is limited to that produced by a predetermined pressure in the associated chamber 105. Both pistons 97 and 104 are then released.

The compressive force on the embossment 36 is transferred to the contact area between the flange 78 and edge area of the aperture 37. By reaction forces, this preload in the embossment 36 is carried at the other areas of contact between the elements of the burner head 12, 13 and between the outer shell element 21 and flange 39. By advancing the pistons 97 and 104 with a predetermined pressure, and therefore a predetermined force, a uniform preload is applied to the embossment 36 regardless of dimensional variations of the burner head elements and base plate 11.

As discussed above, the base plate 11 is coated on all of its surfaces by a porcelain enamel. Ideally, the exposed or visible outer surfaces of the outer shell 21 and burner cap 23 are porcelain-coated, while their inner surfaces, i.e., those facing the plenum chamber 35, are uncoated. Preferably, the inner shell 22 is not coated with porcelain enamel, but may be coated with a noncorrosive metallic coating. The burner head elements 21, 22, 23 as well as the sheets 16 and 17, are preferably formed of sheet or uniform thin-walled steel stock.

A characteristic of a fired porcelain coating is a nonwetting or pull-back of the coating from the edge areas of a coated steel body. More specifically, the corner or junction between an end face and a major surface of a sheet or thin wall element is substantially free of porcelain. This characteristic is put to advantage, in accordance with an important aspect of the invention, to eliminate the need for gaskets or other separate sealing means at the joints between the various elements of the burner heads 12 and 13 and the connection between the burner heads and the base plate.

Inspection of FIG. 3 reveals that a peripheral corner or junction 107 formed between an end face 108 of the burner head supporting flange 39 and an outer surface 109 is substantially free of the porcelain enamel coating, designated 110, on the base plate 11. This condition permits a direct metal-to-metal gastight seal between the corner 107 and the adjacent surface 67 of the outer shell flange 66. By arranging the shell flange 66 to be engaged obliquely by the flange 39, contact of the flange surface 67 by the peripheral corner 107 is assured. In addition to the peipheral metal-to-metal seal detailed in FIG. 3, the various elements of the burner heads 12 and 13 are similarly arranged with their respective porcelain-coated wall portions engaging adjacent surfaces at oblique angles, as mentioned above, at the remaining sealing points, designated 111, 112, 113, so that their associated porcelain-free peripheral corners provide metal contact.

As seen in FIG. 3, the end face or edge 108 of the flange 39 or the end face or edge of other uniform thin-walled porcelain-coated elements retains a minimum amount of porcelain enamel from the coating and firing processes. Moreover, these end faces or edges may be masked or a residual porcelain coating may be removed after firing so that the end face may be used to form a direct seal with an adjacent surface in accordance with certain aspects of the invention. As used herein, the term "edge" is defined as the boundary of a thin-walled element, and is generic to both the term "end face" and the term "corner" defined above as the junction of an end face and a major surface of the element in question.

As disclosed above, the various parts of the burner heads 12 and 13 and base plate 11 are formed of steel so that the parts have the same coefficient of thermal expansion. This ensures that the engagement forces between the elements at the flange corner 107 and points 111, 112, and 113, upon heating of a burner head, will not decrease and create the possibilty of a leak. The contact forces, in fact, by differential expansion of the elements tend to increase. During burning of gas, the outer shell 21 is exposed to a larger heat input than the inner shell 22. The outer shell is in contact with the flame and is exposed to radiant heat emanating from the flame. By contrast, the inner shell is protected from the radiant energy of the flame, and it is cooled by secondary air rising through its interior. Thus, during start-up and during steady state burning operation, the inner shell 22 expands to a lesser degree longitudinally or axially than the outer shell 21, so that an increase in tension is produced in the inner shell and the sealing contact force at the flange corner 107 and various other sealing points 111, 112, and 113 is increased to assure positive sealing action.

While we have described our invention in connection with specific embodiments thereof, it is to be clearly understood that this is done only by way of example, and not as a limitation to the scope of our invention as set forth in the objects thereof and in the appended claims.

What is claimed is:

1. A method of applying ceramic frit to a sheet metal burner assembly base plate formed of a pair of joined overlying metal sheets having an integrally embossed air-gas duct formed therebetween, comprising the steps of substantially entirely immersing the joined metal sheets in a slurry of ceramic frit and simultaneously pressurizing a volume of slurry material at the exterior of the sheets whereby ceramic frit particles are forced into crevices existing between the sheets, removing the sheets from the slurry and subsequently firing the frit onto the sheets whereby the said particles driven into the crevices between the sheets are fused to seal said crevices.

2. The method as set fourth in claim 1 wherein slurry material in the air-gas duct is induced by a pressurized supply to flow through the ducts with sufficient velocity and turbulence while the duct is filled with the slurry, whereby air entrapped in said duct is displaced by such flow and substantially complete internal coating of said duct is achieved.

3. A method as set forth in claim 2, wherein said duct includes an air-gas inlet end, a delivery end and a restricted portion adjacent said inlet and between said inlet and delivery, said slurry flow being induced from said delivery end to said inlet end whereby said restricted portion is utilized to develop pressure in said duct by restricting the induced slurry flow.

4. A method as set forth in claim 3, wherein the slurry flow through said ducts is recirculated through a tank in which said base plate is immersed.

5. The method of porcelain enamel coating the interior of an air-gas duct integrally formed by embossment of one or both of a pair of joined, overlying metal sheets which comprises filling the duct with a slurry of ceramic frit particles and inducing a pressurized flow of the slurry through the duct with sufficient pressure to drive the frit particles into crevices between the sheets communicating with the duct interiors, and with sufficient velocity and turbulence to remove air pockets from the duct while the duct remains filled with slurry, removing the slurry from the duct and thereafter firing the burner plate to fuse the said particles remaining in the duct and the crevices communicating with the duct to thereby seal the duct against gas leakage through said crevices.

* * * * *

UNITED STATES PATENT AND TRADEMARK OFFICE

CERTIFICATE OF CORRECTION

PATENT NO. : 4,009,302

DATED : February 22, 1977

INVENTOR(S) : William P. Biddle; John J. Tacker

It is certified that error appears in the above-identified patent and that said Letters Patent are hereby corrected as shown below:

Column 1, line 18, change "apperance" to -- appearance --.

Column 1, line 22 and continued on line 23, change "emameled" to -- enameled --.

Column 1, line 50, after "used to form" insert -- a --.

Column 3, line 40, change "side" to -- sides --.

Column 3, line 45, 4th paragraph of Column 3, after "In" change "the" to --a--.
Column 3, line 45, 4th paragraph of Column 3, change "mixtue" to --mixture--.

Column 3, line 63, change "frame" to -- flame --.

Column 4, line 58, change "send" to -- end --.

Column 7, Claim 1, line 12, after "pressurizing a volume of slurry material" insert -- in the duct relative to the pressure of the slurry material -- .

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*